US011162218B1

(12) United States Patent
Clayton

(10) Patent No.: US 11,162,218 B1
(45) Date of Patent: Nov. 2, 2021

(54) BIOMASS PULP DIGESTER

(71) Applicant: Robert Clayton, Largo, FL (US)

(72) Inventor: Robert Clayton, Largo, FL (US)

( * ) Notice: Subject to any disclaimer, the term of this patent is extended or adjusted under 35 U.S.C. 154(b) by 0 days.

(21) Appl. No.: 17/226,143

(22) Filed: Apr. 9, 2021

Related U.S. Application Data

(63) Continuation-in-part of application No. 17/037,990, filed on Sep. 30, 2020.

(51) Int. Cl.

| | |
|---|---|
| ***D21B 1/30*** | (2006.01) |
| ***D21C 7/02*** | (2006.01) |
| ***D21C 9/02*** | (2006.01) |
| ***D21C 9/18*** | (2006.01) |

(52) U.S. Cl.
CPC ..... *D21C 7/02* (2013.01); *D21C 9/02* (2013.01); *D21C 9/18* (2013.01)

(58) Field of Classification Search
CPC .... B30B 9/12; B30B 9/14; B30B 9/26; B30B 9/121; B30B 9/124; B30B 9/122; B30B 9/18; D21B 1/30; D21B 1/028; D21B 1/12; D21B 1/22; D21B 1/32; B65D 88/546; Y10S 222/01; D21C 7/02; D21C 7/06; D21C 7/08; D21C 7/00; D21C 9/02; D21C 9/18; D21C 9/00; B65B 1/12
USPC .... 222/368, 412, 167; 162/137, 246, 28, 18, 162/52
See application file for complete search history.

(56) References Cited

U.S. PATENT DOCUMENTS

| | | | | |
|---|---|---|---|---|
| 2,149,736 A * | 3/1939 | Hiller | B30B 9/127 100/41 |
| 2,159,258 A | 5/1939 | De La Roza, Sr. | |
| 2,355,091 A | 8/1944 | McDonald | |
| 3,007,839 A | 11/1961 | Richter | |
| 3,200,032 A | 8/1965 | Richter et al. | |
| 3,298,899 A | 1/1967 | Laakso | |
| 3,518,936 A * | 7/1970 | Bredeson | B30B 9/12 100/117 |
| 3,982,483 A * | 9/1976 | Bird | B30B 9/121 100/117 |

(Continued)

OTHER PUBLICATIONS

Vincent Corporation, Pulp and Paper Screw Presses (older brochure), Apr. 5, 2010, https://vincentcorp.com/content/pulp-paper-screw-presses-older-brochure/, last accessed on Jun. 24, 2020.

*Primary Examiner* — Charles P. Cheyney
(74) *Attorney, Agent, or Firm* — Larson & Larson, P.A.; Justin P. Miller; Frank Liebenow

(57) ABSTRACT

The multi-stage modular horizontal digester is primarily comprised of a single auger in a horizontal orientation. The single auger includes sections of lesser and greater inner diameter, thus creating sections of that allow for mixing and time to operate on the contents, and sections where the liquids are squeezed out. As compared to the known processing methodology, the multi-stage modular horizontal digester creates numerous benefits. For example, by maintaining elevation of the pulp, it can be directly expelled into the hydrapulper without the need for an additional pump. Processes can be changed quickly by altering the rotation speed, auger sections, or chemical inputs and outputs without the need to move heavy tanks or adjust pumps. In other words, there is no need for the standard cascade-style system where the pulp descends through a step, is raised to the next step, and so forth.

6 Claims, 12 Drawing Sheets

(56) References Cited

U.S. PATENT DOCUMENTS

| | | | | | |
|---|---|---|---|---|---|
| 4,025,001 | A * | 5/1977 | Yarem | A22C 17/04 | 241/24.16 |
| 4,289,067 | A * | 9/1981 | Hanak | B30B 9/12 | 100/117 |
| 4,297,943 | A * | 11/1981 | Laurich-Trost | B30B 9/26 | 100/129 |
| 4,581,992 | A * | 4/1986 | Koch | B30B 9/121 | 100/117 |
| 5,215,374 | A * | 6/1993 | Meyer | B29C 48/53 | 366/90 |
| 5,244,373 | A * | 9/1993 | Capelle | B29B 7/421 | 425/208 |
| 5,939,571 | A * | 8/1999 | Foidl | C11C 3/10 | 554/12 |
| 7,354,188 | B2 * | 4/2008 | Uphus | B29C 48/585 | 366/77 |
| 8,871,089 | B2 | 10/2014 | Early et al. | | |
| 9,650,598 | B2 * | 5/2017 | Vogelsang | C12M 21/04 | |
| 10,588,331 | B2 | 3/2020 | Popa et al. | | |
| 10,669,521 | B2 | 6/2020 | Allen et al. | | |
| 2015/0299010 | A1 | 10/2015 | Rezin | | |
| 2016/0001516 | A1 | 1/2016 | Roiss | | |

* cited by examiner

BIOMASS PULP DIGESTER

RELATED APPLICATIONS

This application is a continuation-in-part of U.S. patent application Ser. No. 17/037,990, titled Biomass pulp digester, filed Sep. 30, 2020.

FIELD

This invention relates to the field of pulp processing and more particularly to a modular, multi-stage, horizontal digester for use processing plant fibers, such as hemp fibers.

BACKGROUND

The processing of plant fibers is currently a centralized operation. Thus, a farmer who harvests plant fibers, such as hemp, must collect the fibers for transport and then move the fibers over long distances to reach a large, centralized processing plant. Following processing, the fibers must again be moved for subsequent rendering into paper, clothing, and so forth.

This methodology makes farmers beholden to large entities that are physically far from the location of harvest.

Furthermore, the existing, centralized processing systems are flawed.

The conventional processes use batch soak tanks with off-the-shelf bulk-handling equipment such as pumps, elevators, conveyors, skip loaders, expellers, and augurs. Off-the-shelf equipment is expensive and cannot be adjusted to match the speed of upstream or downstream equipment, necessitating the use of buffer tanks between machines.

Such systems are assembled in a multi-story scaffold with material cascading from one level to the next. The scaffolding is expensive and makes maintenance difficult. Holding tanks require level controls and emergency shutoffs, thus making automation expensive and failure-prone. Most industrial accidents relate to control failures and operator errors that the multi-stage modular horizontal digester eliminates.

What is needed is a smaller, modular digester that can be located near the harvest location, reducing transportation costs and providing farms with flexible processing.

SUMMARY

The multi-stage modular horizontal digester is primarily comprised of a single auger in a horizontal orientation. The single auger is divided across components, the auger differing in shape and diameter depending on the operation to be performed by the given component.

By selecting and combining components in differing arrangements, many different pulp digestion steps can be performed.

Specifically, the multi-stage modular horizontal digester maintains a slow, constant flow of pulp, varying only the solvent speeds and wash water speeds to achieve the required volume changes of fluids as the pulp passes slowly through the stages.

The benefits of the system, as compared to previous systems, are numerous:

- The single elevation saves many levels of expensive scaffolding and simplifies access for maintenance.
- The buffer tanks are eliminated between stages, with elimination of the associated handling problems.
- The single-speed control is easy to automate and shut down.
- Solvent velocity is independent of pulp velocity. Solvents can be pumped through, whether co-current (with the pulp flow) or counter-current (against the pulp flow), at sufficient rates to achieve the desired volume changes per hour.
- The rotational speed is preferably set at one revolution-per-minute (RPM), with the option of increasing/decreasing speed as needed for different processes. At one RPM, the disclosed system makes thirty-five volume changes per hour.

The multi-stage modular horizontal digester includes the following components:

With respect to augers, there are two primary types of auger screw: a transportation section and a compression section.

A transportation section includes an auger of consistent inner diameter. In a transportation section, the pulp is permitted to mix and react as it would in a tank but without the associated change in elevation.

A compression section includes an auger of increasing inner diameter. The corresponding consistent inner diameter of the vessel results in a decrease in area available to the pulp, thus pushing entrained liquids out through a filter. The liquids, whether solvent, wash fluid, or other, may be recycled and re-used.

The preferred embodiment of the auger of the compression section includes an auger with a two distinct pitch sections: a first section with a high pitch to accelerate the pulp into a plug, the plug intended to prevent backflow of fluid; and a second section of lower pitch, but also greater central diameter, compressing the plug against the walls of the filter, pressing out fluids.

This modified compression auger with two distinct pitch sections is only required where the pulp has a high ratio of liquids-to-solids, and backflow around the auger may be a problem.

The auger is formed from separable sections. Thus, a user can choose the sections that best fit the process requirements. The sections will transfer rotational motion using a protrusion/recess arrangement, much like a socket and a bolt head. By adjusting the sizing of the protrusion and recess, differing tolerances for misalignment can be created.

The shafts are preferably formed from hollow pipes, each pipe terminated with an end cap. Using a hollow pipe, rather than a solid shaft, reduces weight. The lower weight simplifies handling of the augers both during the initial machining and during later assembly/disassembly.

The augers are supported by bearings, preferably located at the junctions between adjacent auger sections. The bearings are split, allowing the augers to be readily removed from the digester. To permit flow around the bearings, the bearing support structure includes portals or pass-throughs. Journal bearings are preferably used to reduce friction.

The auger is optionally perforated to promote mixing of the pulp during rotation of the auger. While perforation in proves mixing, pulp is moved less efficiently through the digester.

To perforate, holes are drilled in the auger coil prior to affixing the coil to the shaft. The size, quantity, and spacing of the holes is chosen based on the desired application. In one embodiment, the holes are drilled out of phase—not in-line with each other—thus preventing a straight-through path through the digester, which would effectively short-circuit the auger.

The compression section includes a filter. The filter is preferably formed from square bars, the square bars slightly separated to permit liquid to flow out from between the bars. The square bars are set parallel to the axis of rotation. Due to their square profile and radial positioning, the gap between the bars increases as the pulp moves further out from the center of the auger. Thus, fibers and particles that become trapped between the square bars spacing see a wider path as they are pushed through, helping with cleaning. Larger fibers push along the inside surface of the grid bars, scraping the interior surface clean. The result is a continuously self-cleaning design that does not require filter screens and screen cleaning.

As an optional feature, the square bars taper along their length, creating a greater filter gap downstream. Thus, as the trapped pulp pushes debris along the inside of the bars, larger debris can escape downstream.

Regarding construction of the device, the shell or external wall is preferably formed from a thin-walled pipe of corrosion-resistant metal. The materials can match across segments, or differ to accommodate the process within the transportation/holding segment. For example, processes that use acid solvents are best performed within stainless steel or related alloys, but wash water can use common steel or polymer materials.

The external walls are optionally wrapped in heat tracing or external steam jackets. Or ports can allow for steam injection into the process. Steam may interact with the solvents present in the process, but for some processes this interaction is desirable.

With an understanding of the components of the multi-stage modular horizontal digester, a discussion of common processes is helpful.

Generally, the process begins with the introduction of pulp, which is a mixture of fibers, such as hemp, and process fluid, such as water.

The input pulp is forty to sixty percent solids, the remainder being fluid. The first expeller expels the process fluid for reuse. This fluid is referred to as the "extract", which is defined here as approximately ninety-four percent water and approximately six percent biochemicals.

The pulp then sits within a digestion section, a type of transportation section, allowing the solvents time to act upon the fibers. The time spent in the digestion section is governed by the length of the digestion section auger, the pitch of the digestion section auger, and the speed of rotation.

After the digestion section is a solvent expeller—expelling segment—where the solvent is forced out of the pulp through a filter.

The wash solution is then added, the pulp passing into the wash segment/section. As with the digestion section, the time spent in the wash section is governed by the length of the wash segment auger, the pitch of the wash section auger, and the speed of rotation.

Finally, the pulp optionally passes through a wash fluid expeller, or directly into a hydrapulper for further processing.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
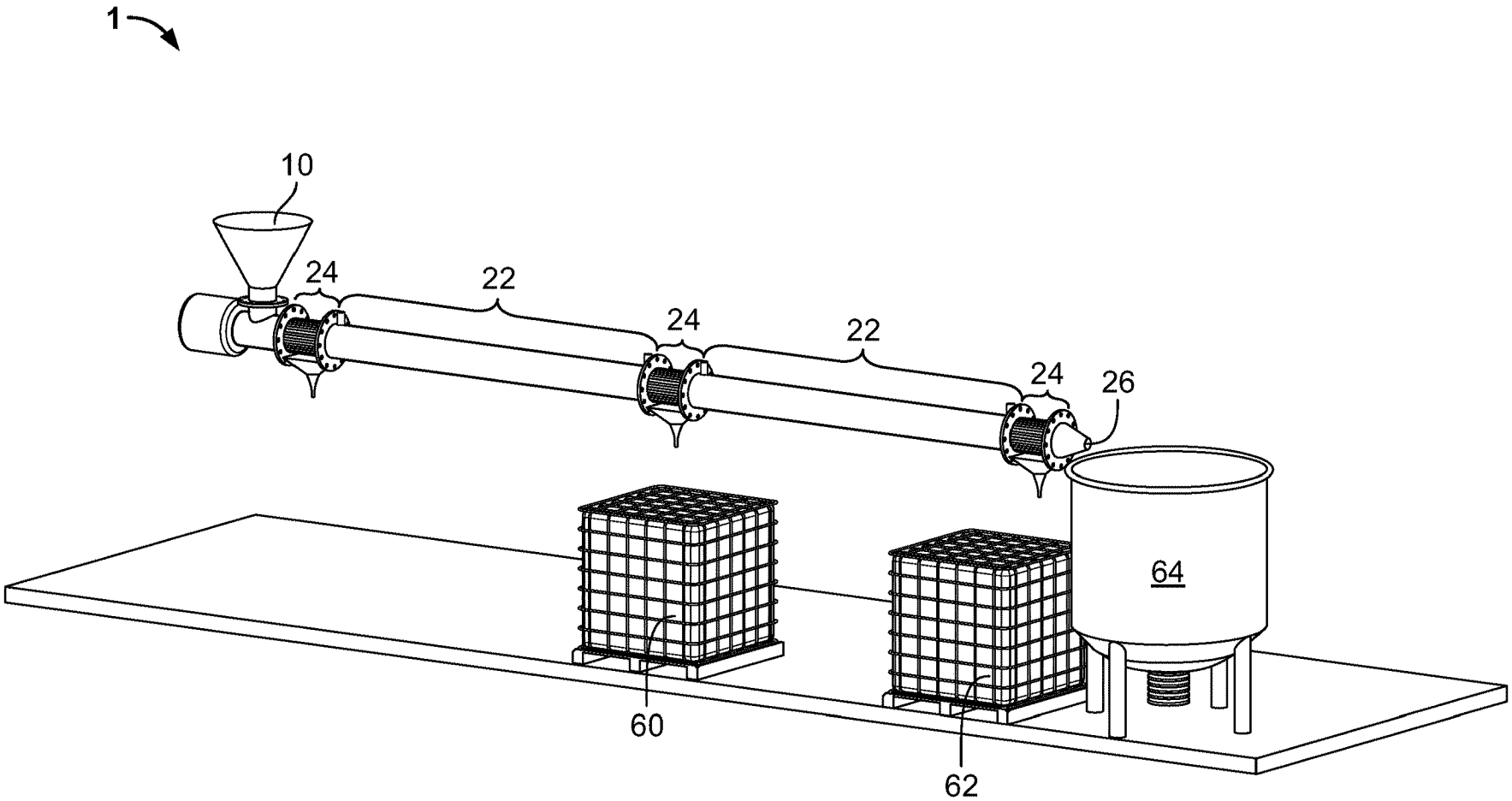
FIG. 1 illustrates a first isometric view of the multi-stage modular horizontal digester.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first isometric view of the multi-stage modular horizontal digester is shown.

The multi-stage modular horizontal digester 1 includes a pulp input location 10, after which pulp 100 (see FIG. 3) is carried to a series of expelling segments/sections 24 and holding segments/sections 22 before reaching the discharge 26 into the hydrapulper 64.

Also shown are the solvent holding tank 60 and wash solution holding tank 62.

Figure 2:
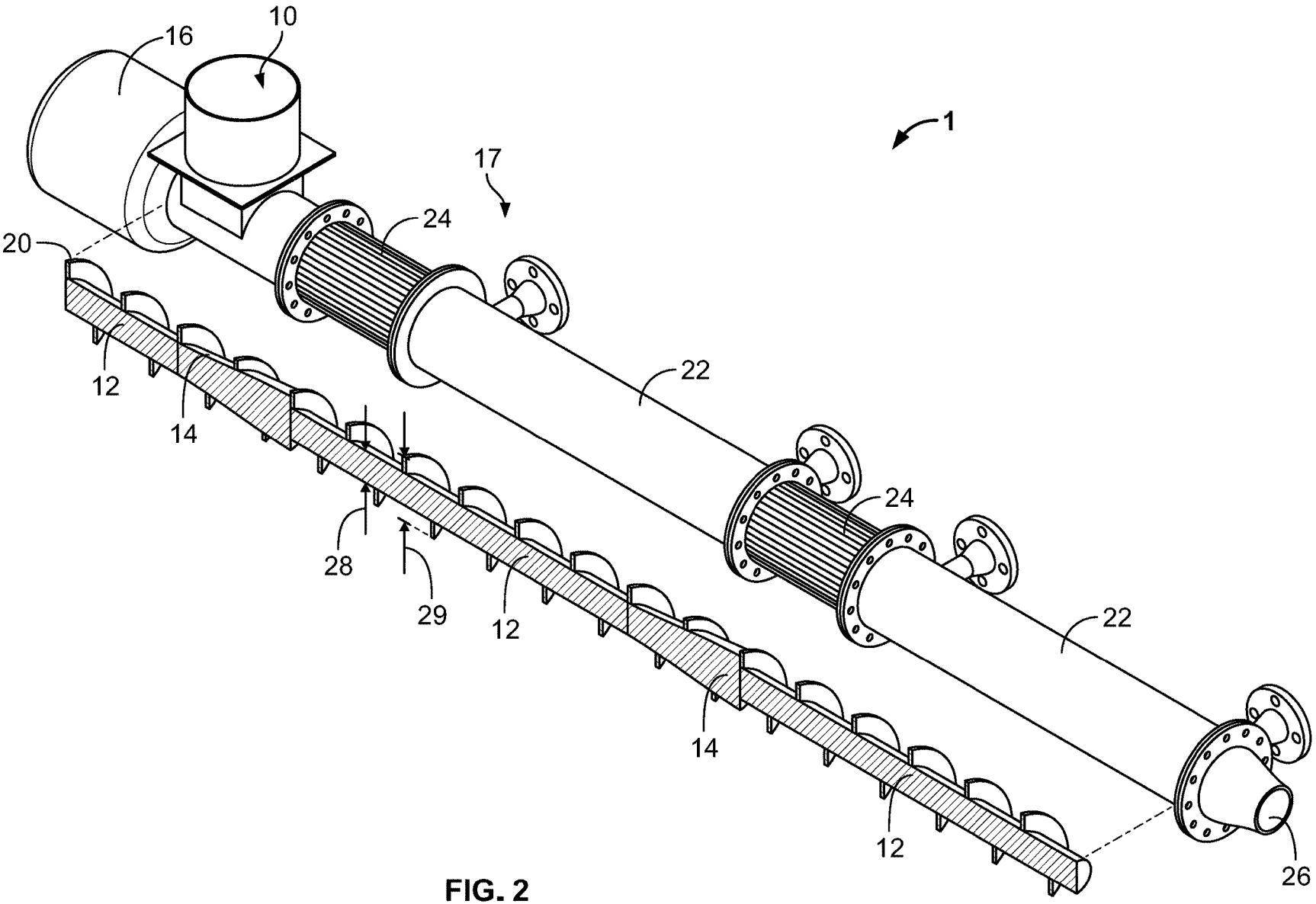
FIG. 2 illustrates a second isometric view, including a cross-section of the auger, of the multi-stage modular horizontal digester.

Referring to FIG. 2, a second isometric view, including a cross-section of the auger, of the multi-stage modular horizontal digester is shown.

The multi-stage modular horizontal digester 1 includes a pulp input location 10, where the pulp 100 (see FIG. 3) drops into the auger 20, specifically transportation section 12. Rotation of the auger 20 by driver 16 carries the pulp 100 to the compression section 14, eventually to the discharge 26. Note that the compression sections 14 generally include shrouds to prevent spraying of liquids, but the shrouds are omitted for clarity.

The auger 20 has two primary measurements: an auger root diameter 28 and an auger major diameter 29. The auger major diameter 29 remains consistent. The auger root diameter 28, or minor diameter, is consistent in transportation sections 12, and increases in compression sections 14. The result is compression of the pulp 100 and expulsion of liquids.

Figure 3:
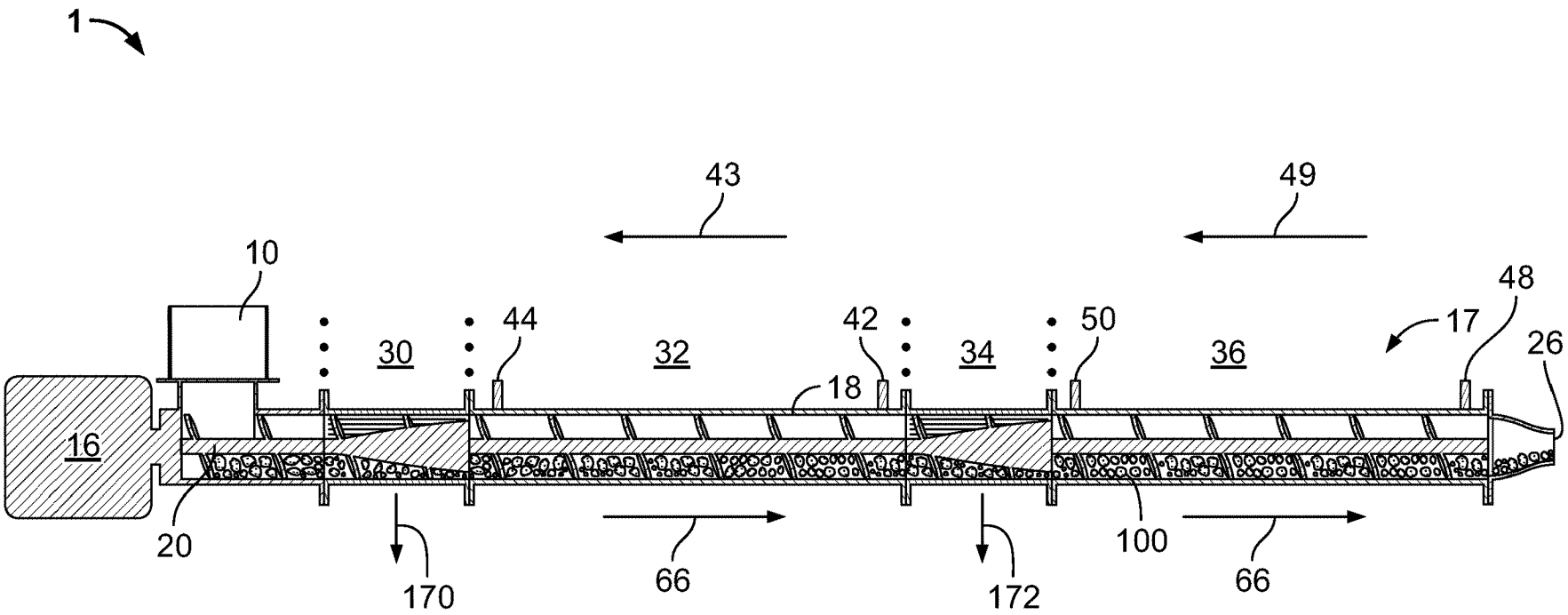
FIG. 3 illustrates a cross-sectional view of the multi-stage modular horizontal digester.

Referring to FIG. 3, a cross-sectional view of the multi-stage modular horizontal digester is shown.

The multi-stage modular horizontal digester 1 is shown in cross-section. The vessel 17, or body inside of which the auger 20 lies, includes a vessel inner diameter 18, which remains consistent.

The pulp 100 first passes through the process fluid expeller 30, squeezing out expelled extract 170.

The pulp 100 passes through the digestion section 32, moving in pulp flow direction 66, moving against the solvent flow direction 43. Thus, the solvent is introduced at solvent input 42, moving in solvent flow direction 43, and exiting at the solvent discharge 44.

Pulp continues to the solvent expeller 34, where any entrained solvent leaves as expelled solvent 172.

The pulp 100 continues, passing through the wash segment 36, moving in pulp flow direction 66, moving against the wash solution flow direction 49. Thus, wash solution is introduced at the wash solution input 48, moving in the wash solution flow direction 49, and exiting at the wash solution discharge 50.

Entrained wash solution is discharged as expelled wash 174.

The pulp 100 then exits at the discharge 26.

Figure 4:
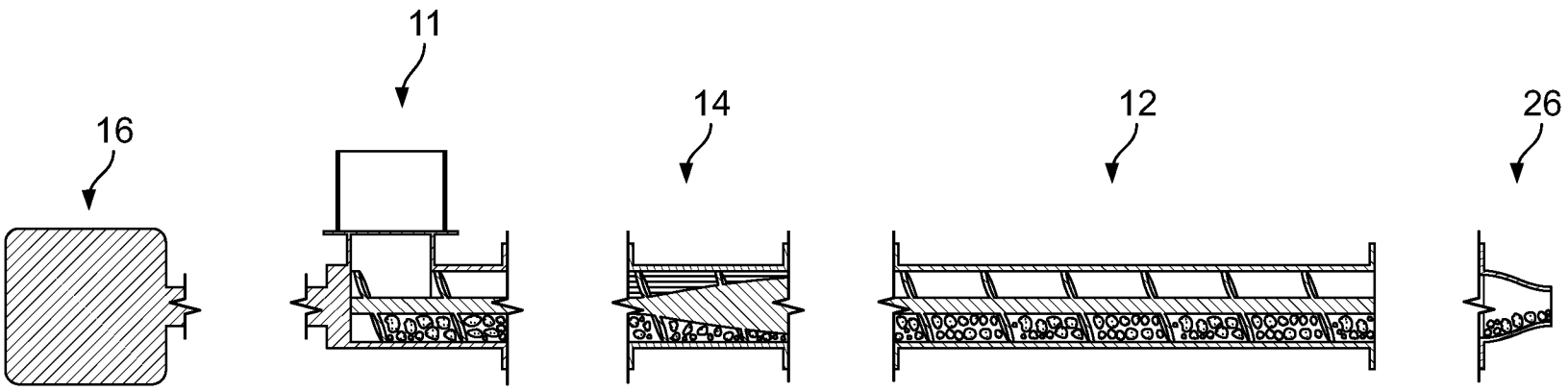
FIG. 4 illustrates a view of the components of the multi-stage modular horizontal digester.

Referring to FIG. 4, a view of the components of the multi-stage modular horizontal digester is shown.

The multi-stage modular horizontal digester 1 is shown separated into its components: driver 16; input section 11; compression section 14; transportation section 12; and discharge 26. The elements are configurable to allow a user to adapt the multi-stage modular horizontal digester 1 to the required process.

Figure 5:
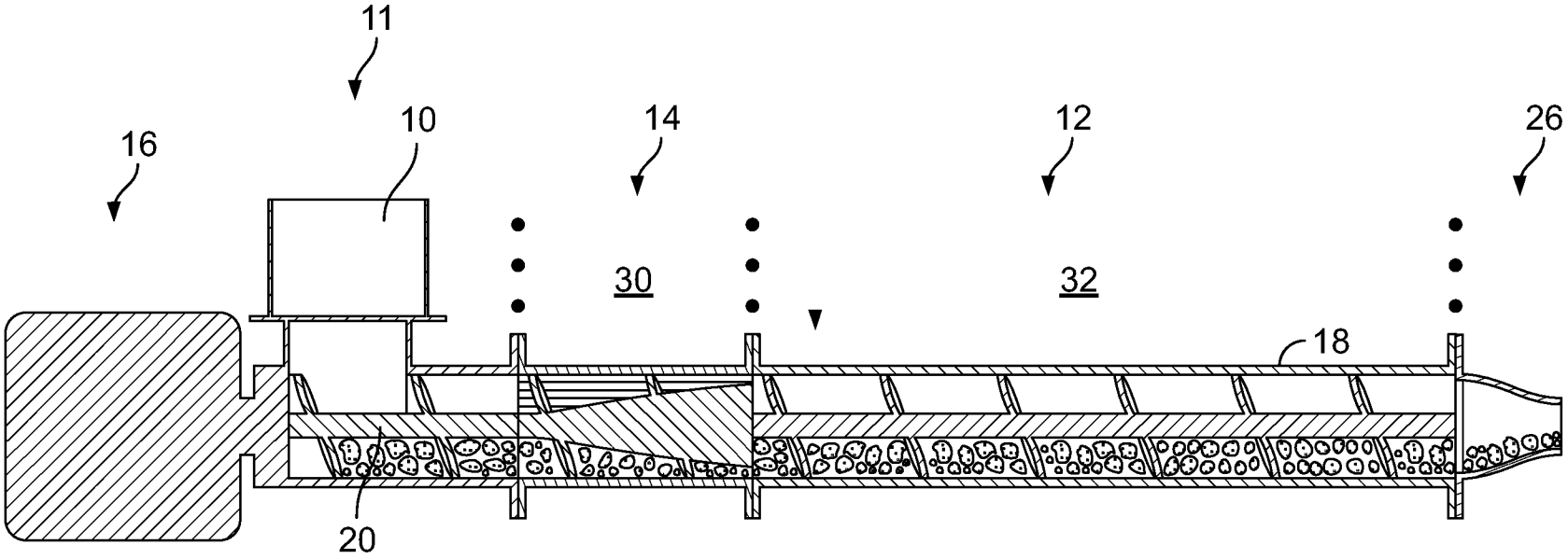
FIG. 5 illustrates a short embodiment of the multi-stage modular horizontal digester.

Referring to FIG. 5, a short embodiment of the multi-stage modular horizontal digester is shown.

With only a single compression section 14 and transportation section 12, the process is simple, resulting in a short multi-stage modular horizontal digester 1.

Figure 6:
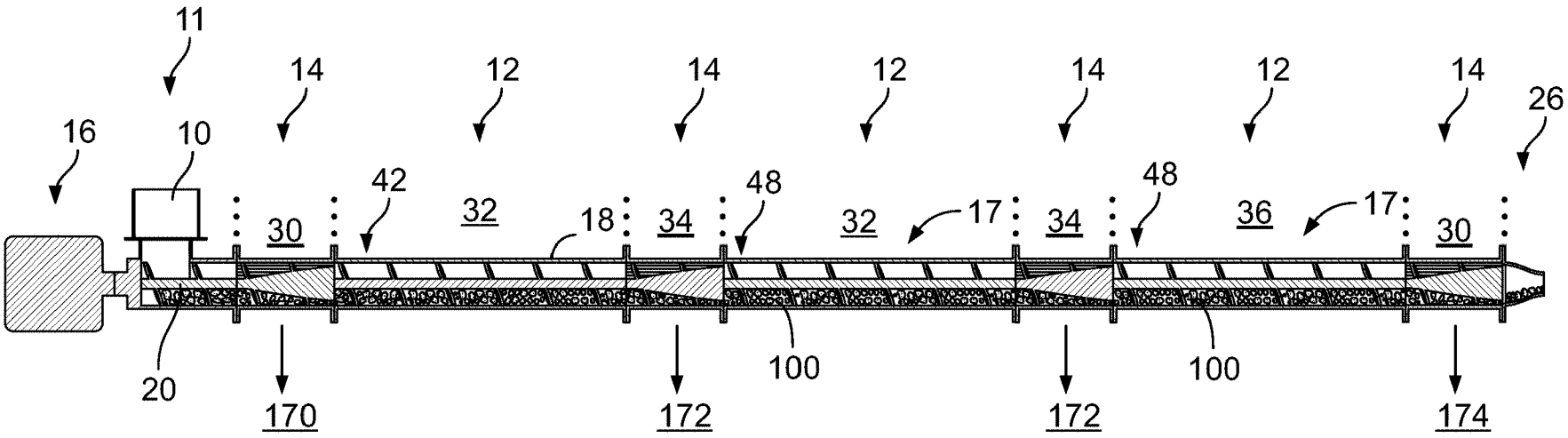
FIG. 6 illustrates a long embodiment of the multi-stage modular horizontal digester.

Referring to FIG. 6, a long embodiment of the multi-stage modular horizontal digester is shown.

The compression sections 14 and transportation sections 12 are now repeated, allowing for a more complex process out of the same components of the multi-stage modular horizontal digester 1.

Figure 7:
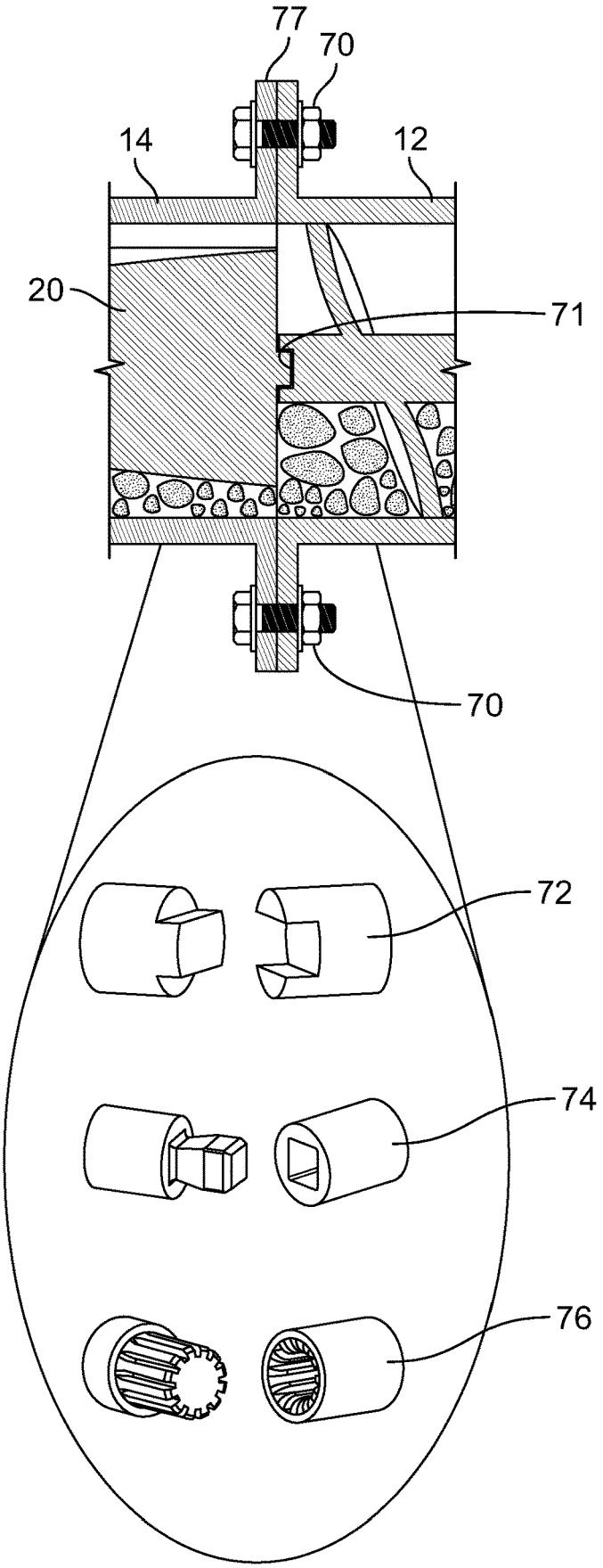
FIG. 7 illustrates a connection detail of the multi-stage modular horizontal digester.

Referring to FIG. 7, a connection detail of the multi-stage modular horizontal digester is shown.

Bolts 70 are shown holding the flange 77 of a transportation section 12 and a compression section 14.

The auger 20 is connected at the auger connection 71, which can be spade connection 72, socket connection 74, or spline connection 76.

Figure 8:
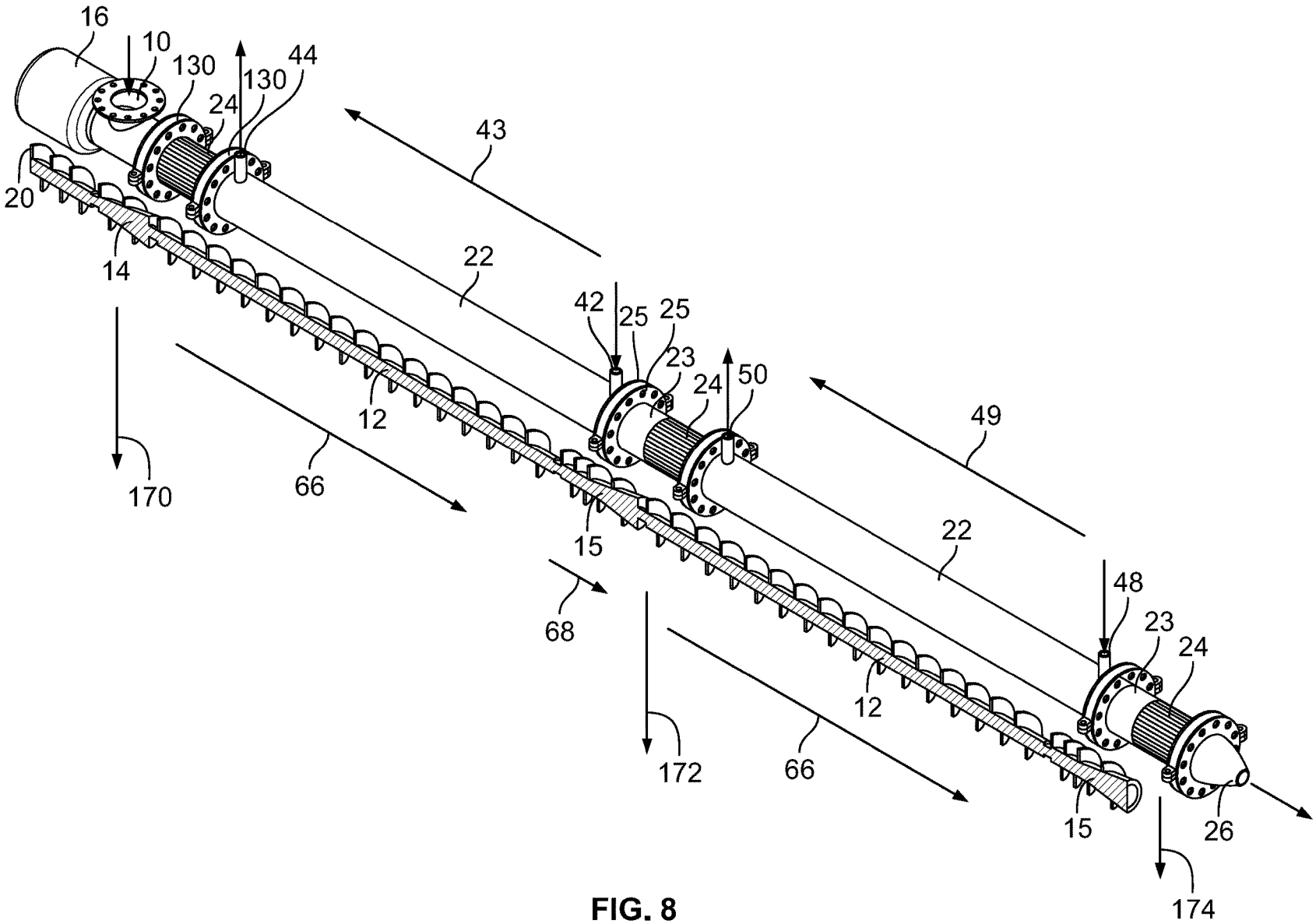
FIG. 8 illustrates an isometric view of a second embodiment, including a cross-section of the auger, of the multi-stage modular horizontal hemp digester.

Referring to FIG. 8, an isometric view of a second embodiment, including a cross-section of the auger, of the multi-stage modular horizontal hemp digester is shown.

The second embodiment of the multi-stage modular horizontal hemp digester 1 is shown with a pulp input location 10 adjacent to the driver 16. The pulp flows through a first expelling segment 24 with internal compression section 14. The first expelling segment 24 squeezes out the expelled extract 170.

The pulp continues into the holding segment 22 with internal transportation section 12, the pulp moving in pulp flow direction 66. The solvent counter-flows with respect to the pulp, the solvent entering at solvent input 42, moving in solvent flow direction 43, and exiting at solvent discharge 44.

The pulp continues into plug-forming segment 23 followed immediately by an expelling segment 24 that squeezes out expelled solvent 172.

As detailed further below, the compression section with plug 15 lies within the plug-forming segment 23 with expelling segment 24, the creation of a plug aiding in removal of fluid from the pulp by decreasing the cross-sectional area of the pulp before creating outward compression.

The formed plug moves in the plug movement direction 68.

In this embodiment, the pulp 100 again flows through another series of processing and compression. This is shown as holding segment 22 with internal transportation section 12, then a plug-forming segment 23 followed immediately by an expelling segment 24. Finally the pulp 100 reaches the discharge 26.

The wash solution also flows against the pulp flow, with wash solution entering at wash solution input 48, moving in the wash solution flow direction 49, and exiting at the wash solution discharge 50.

The final expelling segment 24 discharges any entrained wash as expelled wash 174.

The segments are joined at flanges 25, the flanges separated by an auger support collar 130. The auger support collar 130 allows rotation of the auger 20, while keeping the auger 20 centered within each segment.

Figure 9:
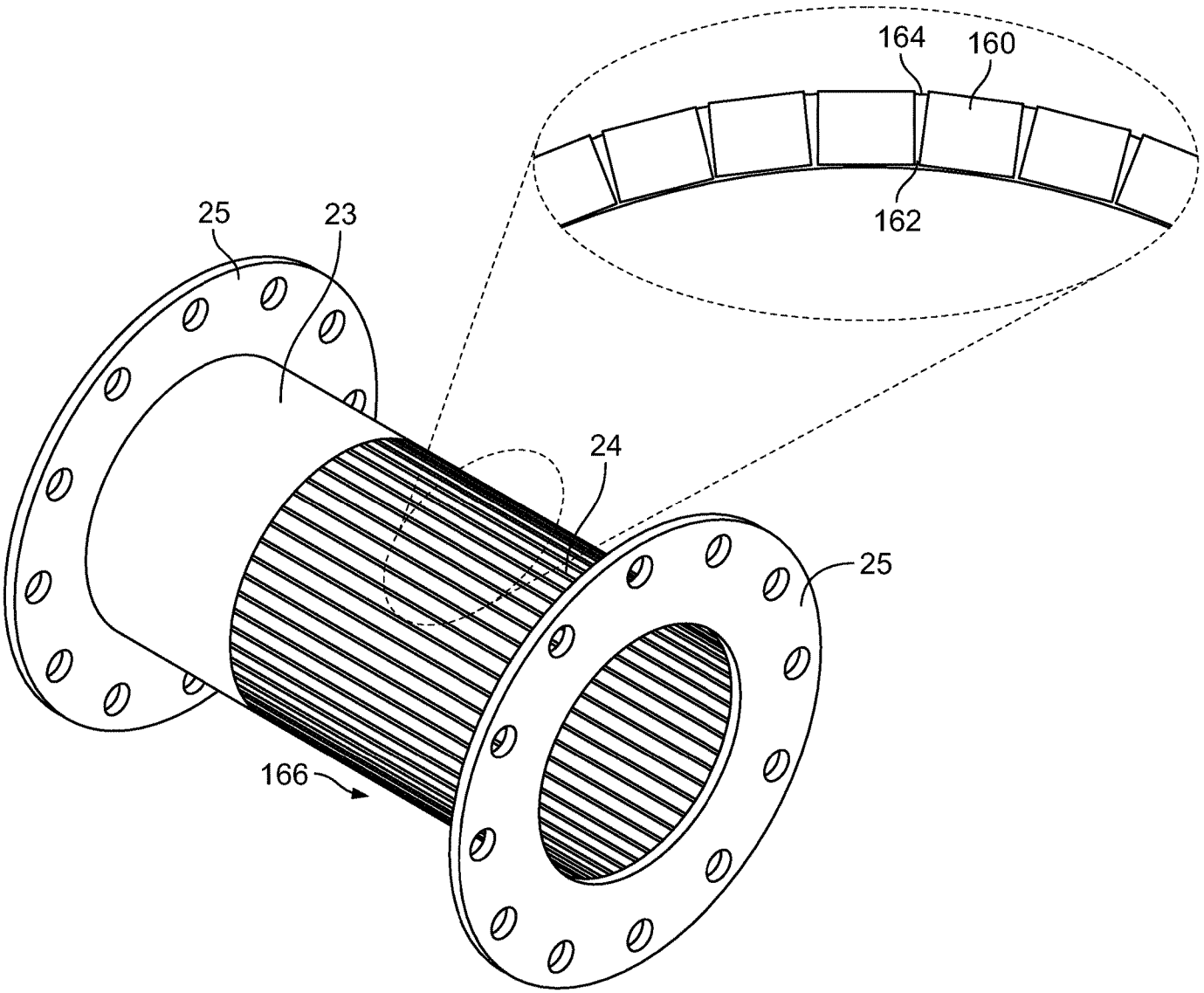
FIG. 9 illustrates a detail view of a filtering/screening/expelling section of the multi-stage modular horizontal hemp digester.

Referring to FIG. 9, a detail view of a filtering/screening/expelling section of the multi-stage modular horizontal hemp digester is shown.

Between the flanges 25 are two sections: a solid section, or plug-forming segment 23, where internally the auger 20 compresses the pulp 100 into a plug, followed by an expelling segment 24 formed by a set of filter bars 160.

The filter bars are preferably square or rectangular in shape, creating a natural widening as the filtered material passes outward—first through a narrow gap 162, then a wide gap 164. This increase in width helps to prevent clogging by making it easier any expelled material to finish passing through the filter.

Additionally, the bars are optionally tapered in direction 166, creating a widening narrow gap 162, creating a multi-stage filter with smaller particles first able to exit, followed by larger particles.

Figure 10:
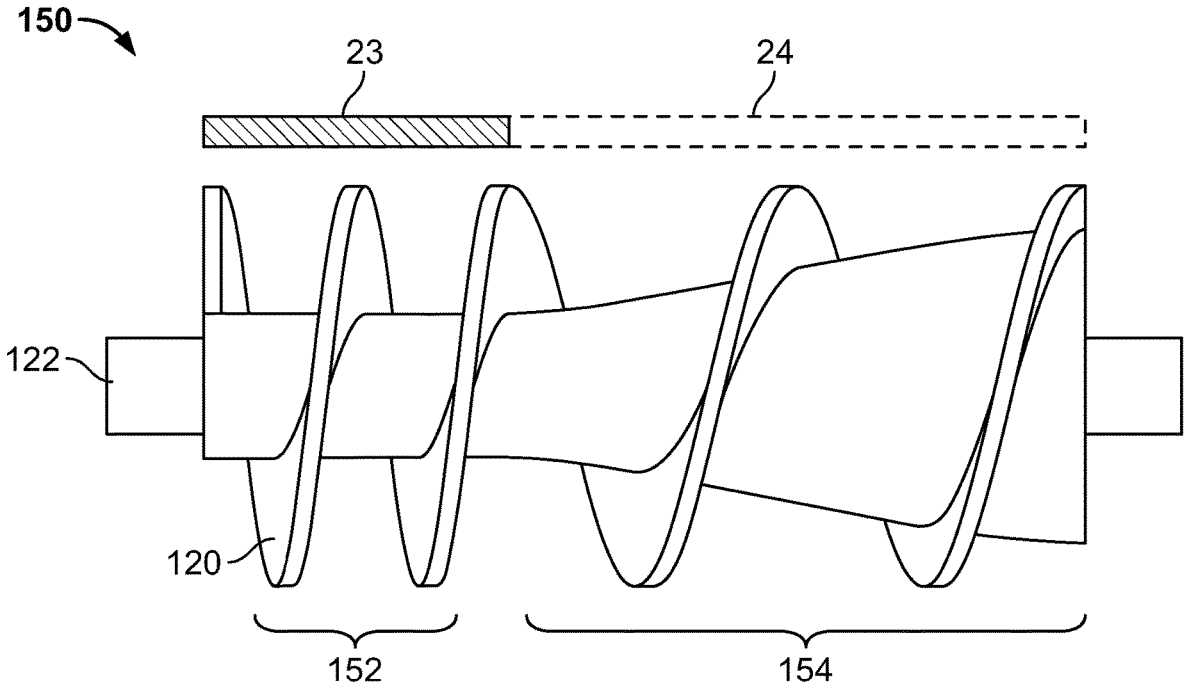
FIG. 10 illustrates a side view of the de-watering auger of the multi-stage modular horizontal hemp digester.

Referring to FIG. 10, a side view of the de-watering auger of the multi-stage modular horizontal hemp digester is shown.

As a specific embodiment of the combination of an auger coil 120 and auger shaft 122, the de-watering auger 150 includes an acceleration-section 152 that forms a plug, and an outward-compression section 154 that presses the resulting plug against the wall of the vessel.

To aid in generation of the plug, the acceleration-section 152 coincides with a solid plug-forming segment 23, and to aid in expulsion of water, the outward-compression section 154 coincides with an expelling segment 24 that acts as a filter.

Figure 11:
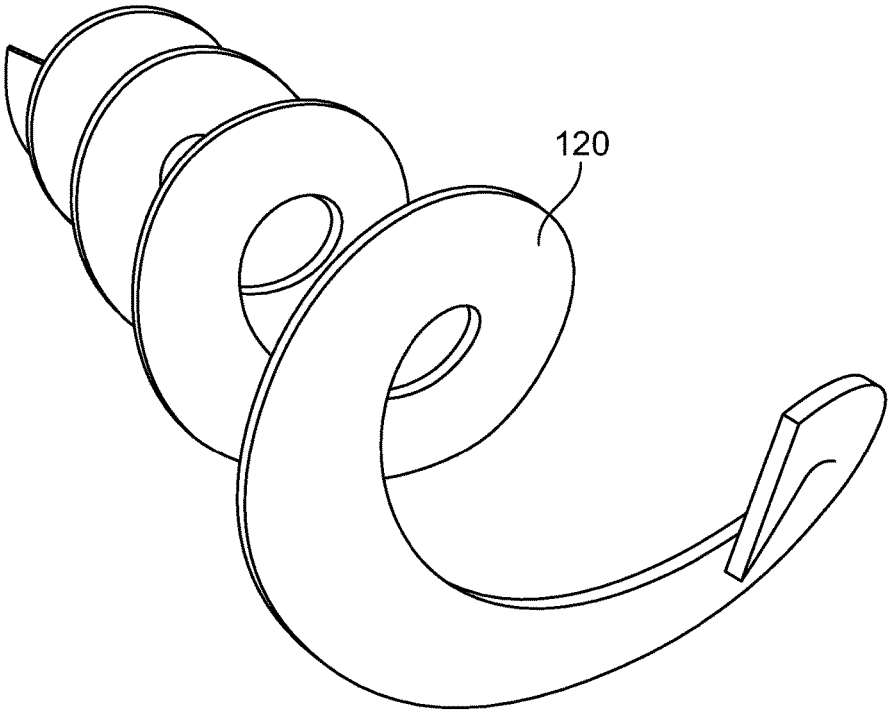
FIG. 11 illustrates an isometric view of a helix of an auger of the multi-stage modular horizontal hemp digester.

Referring to FIG. 11, an isometric view of a helix of an auger of the multi-stage modular horizontal hemp digester is shown.

As an example of construction methodology, the auger coil 120 is shown coiled before being affixed to an auger shaft 122 (see FIG. 10).

Figure 12:
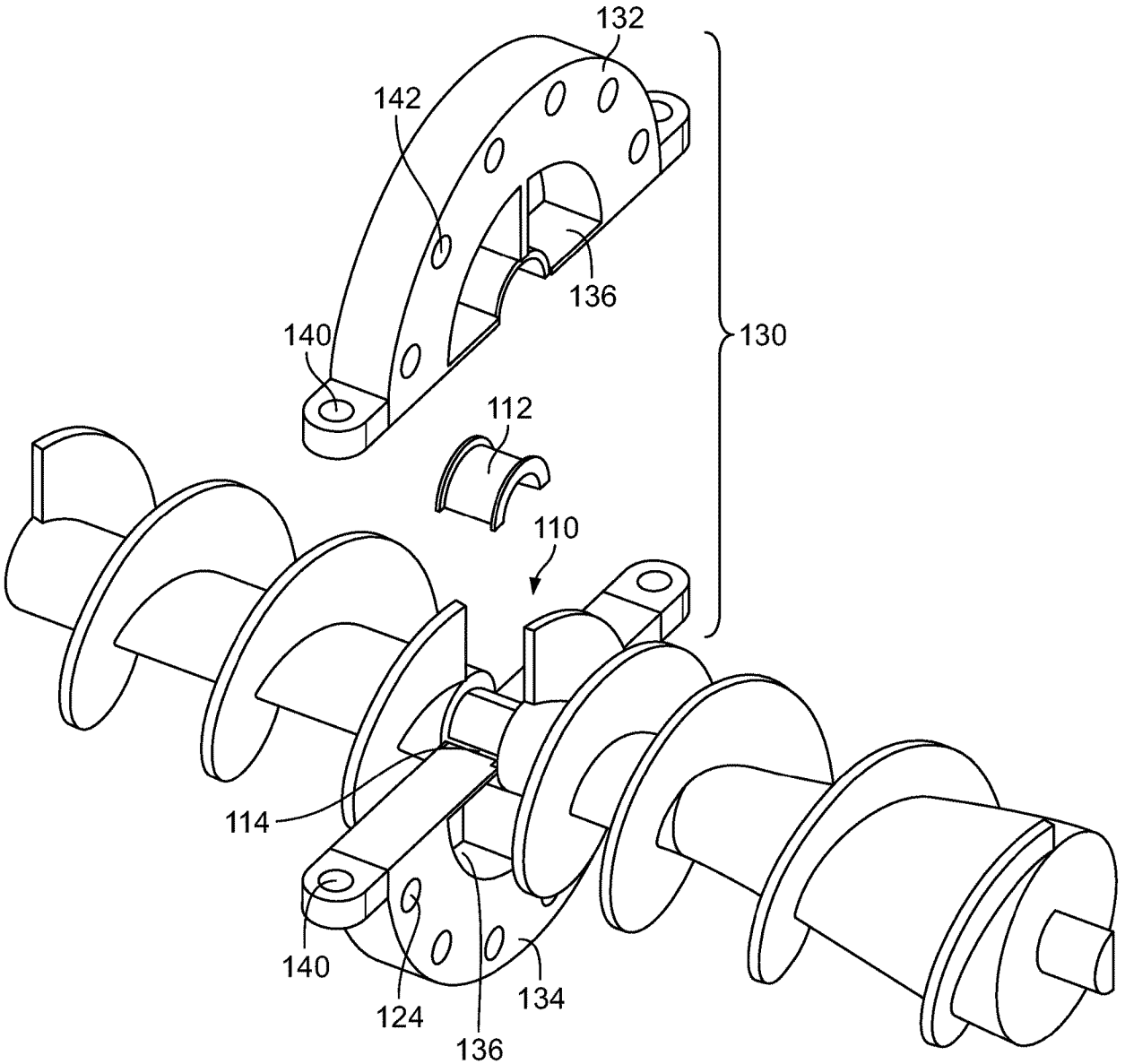
FIG. 12 illustrates a partially-exploded view of an auger support collar with journal bearing of the multi-stage modular horizontal hemp digester.

Referring to FIG. 12, a partially-exploded view of an auger support collar with journal bearing of the multi-stage modular horizontal hemp digester is shown.

The auger support collar 130 is formed from an upper support half 132 and a lower support half 134. Each half 132/134 includes one or more pulp openings 136 to permit flow through the auger support collar 130.

The auger support collar 130 includes collar bolt holes 140 through which bolts (not shown) can be passed to clamp the upper support half 132 to the lower support half 134.

The flange bolt holes 142 allow bolts (not shown) to pass through the auger support collar 130, interacting with the flanges 25 (see FIG. 8).

At the location where the auger shaft 122 contacts the auger support collar 130, a journal bearing 110 is placed to reduce friction. The journal bearing is formed from an upper sleeve 112 and a lower sleeve 114 to simplify maintenance.

Figure 13:
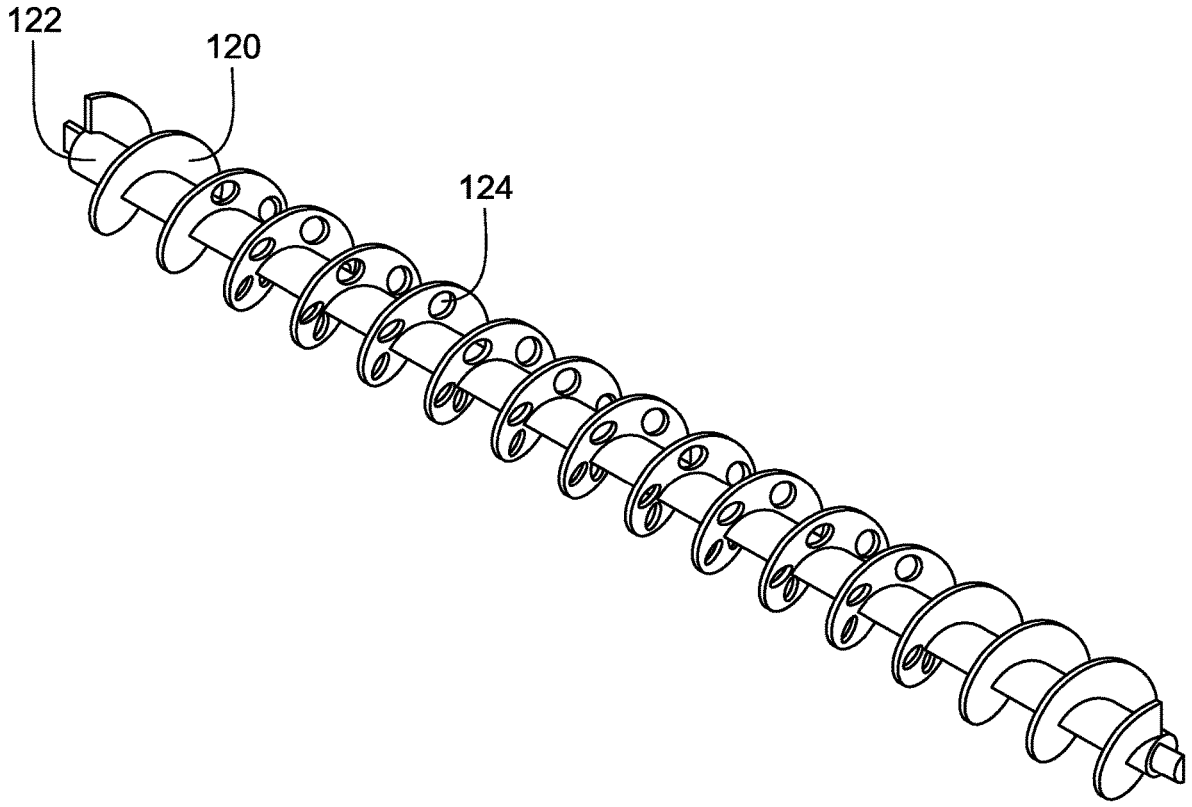
FIG. 13 illustrates an auger with perforations, or holes.

FIG. 13 illustrates an auger with perforations, or holes.

The auger coil 120 is wrapped around an auger shaft 122, the auger coil 120 including a multiplicity of auger coil perforations 124.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction, and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A multi-stage horizontal digester for use breaking down a pulp, the multi-stage horizontal digester comprising:

two or more vessels;

a multi-stage auger with an inner diameter and an outer diameter;

the multi-stage auger within the two or more vessels;

the multi-stage auger including two or more transportation sections and one or more compression section;

one or more auger connections separating the two or more transportation sections and the one or more compression section;

each auger connection of the one or more auger connections allowing the multi-stage auger to be separated and the sections rearranged into a different order;

the two or more transportation sections each having a constant inner diameter and a constant outer diameter, thus allowing the pulp time to mix and break down without a need for use of a holding tank;

the one or more compression section including an increasing inner diameter and a constant outer diameter, pushing the pulp outward against a screen to discharge liquid;

the one or more compression section separating the two or more transportation sections, thus removing fluids from the pulp between the two or more transportation sections;

the two or more vessels joined to each other by flanged connections;

the flanged connections each including an auger support collar, and the flanged connections each matching with one or more auger connections;

each auger support collar surrounding one or more auger connections;

the auger support collar formed from an upper support half and a lower support half;

whereby the multi-stage horizontal digester is separatably at the flanged connections of the two or more vessels, and the one or more auger connections of the multi-stage auger, allowing for reconfiguration and re-ordering of the sections.

2. The multi-stage horizontal digester of claim 1, wherein:

the multi-stage auger of the one or more compression section is a de-watering auger;

the de-watering auger includes an acceleration-section and an outward-compression section;

the acceleration-section wherein a pitch of the multi-stage auger decreases, accelerating the pulp along a length of the multi-stage horizontal digester;

the outward-compression section wherein an inner diameter of the multi-stage auger increases, pressing the pulp outward;

whereby the de-watering auger causes the pulp to create a plug before outward compression to remove water, thus improving de-watering performance.

3. The multi-stage horizontal digester of claim 1, further comprising:

a journal bearing;

the journal bearing placed between the one or more auger connections and the auger support collar associated therewith;

whereby the journal bearing reduces friction between the auger connection and the auger support collar.

4. The multi-stage horizontal digester of claim 1, further comprising:

a set of filter bars;

the set of filter bars surrounding the one or more compression section;

the set of filter bars are arranged parallel to an axis of rotation of the multi-stage auger;

the set of filter bars separated by a filter bar gap;

whereby outward compression of the pulp against the set of filter bars permits discharge of liquid, while keeping solids within the multi-stage horizontal digester.

5. The multi-stage horizontal digester of claim 4, wherein:

the set of filter bars are of a square cross-section;

the set of filter bars taper along their length, increasing the filter bar gap in a downstream direction;

whereby a larger downstream filter bar gap helps to prevent clogging.

6. The multi-stage horizontal digester of claim 1, wherein:

the two or more transportation sections are each a digestion section where solvents break down solids in the pulp; and the one or more compression section is a solvent expeller where solvents are pressed out of the pulp.

* * * * *